US007106172B2

(12) United States Patent
Neveux et al.

(10) Patent No.: US 7,106,172 B2
(45) Date of Patent: Sep. 12, 2006

(54) KEYLESS ACCESS SENSOR SYSTEM

(75) Inventors: Antoine Neveux, Monte Carlo (MC); Marek Gierczak, Meyland (FR); Pascal Schweizer, Saint Martin d'Uriage (FR); Michael James Shelley, West Lothian (GB)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 10/330,309

(22) Filed: Dec. 30, 2002

(65) Prior Publication Data

US 2004/0031908 A1 Feb. 19, 2004

Related U.S. Application Data

(63) Continuation of application No. PCT/GB01/02919, filed on Jun. 29, 2001.

(30) Foreign Application Priority Data

Jul. 1, 2001 (GB) ..... 0016089.5

(51) Int. Cl.
*G08B 29/00* (2006.01)

(52) U.S. Cl. ..... 340/5.72; 340/426.36; 340/556; 340/557; 340/602

(58) Field of Classification Search ..... 340/541, 340/555–557, 505, 10.1, 5.2, 5.7, 5.72, 5.8, 340/602, 426.1, 426.24, 426.28, 426.36; 307/10.1; 180/287, 289

See application file for complete search history.

(56) References Cited

U.S. PATENT DOCUMENTS

| | | | | |
|---|---|---|---|---|
| 5,682,135 | A | 10/1997 | Labonde | 340/426 |
| 6,075,294 | A * | 6/2000 | Van den Boom et al. | 340/541 |
| 6,239,693 | B1 | 5/2001 | Benard et al. | 340/426 |
| 6,577,226 | B1 * | 6/2003 | Steiner | 340/5.62 |

FOREIGN PATENT DOCUMENTS

| | | | |
|---|---|---|---|
| DE | 42 12291 | A1 | 10/1993 |
| DE | 198 43 594 | A1 | 4/2000 |
| GB | 2 336 625 | A | 10/1999 |

* cited by examiner

*Primary Examiner*—Thomas Mullen
(74) *Attorney, Agent, or Firm*—Kermit D. Lopez; Luis M. Ortiz

(57) ABSTRACT

A keyless access sensor system for use with a keyless access control mechanism (KACM) is described for controlling the operation of a locking device. The KACM receives a signal from a sensor device for keyless access to create a first output signal before the user has begun any action on the handle in order to open the door. The first output signal is sent to a general processor, which initiates a recognition process and, after recognition of the authorized user the processor then generates an unlocking signal which unlocks the locking device before the authorized user will have fully accomplished the action of opening the door. Thus the authorized user is allowed to open the door without any specific un-ergonomic and time-consuming additional action to the simple action of actuating the handle to open the door. The second signal is generated by a device, such as a fob, card or the like, carrying a unique digital or analog identification in response to RF or IR interrogation from the general processor after it receives the output signal from the sensor device for keyless access.

33 Claims, 9 Drawing Sheets

CONNECTOR
Connector
74HC4017
CD4001
74HC4066
LM2902M
BC847B
BSS138
Phototrans
Test 1
Test 2
Test 3
Test 4
Test 5
Test 6
Test 7
Test 8
Test 9
Test 10
Test 11
Test 12
Test 13
Test 14
CLK
P1
P2
P3
+5V
24
32
54
60
70
72
73
74
76
80
82
86
88
89
90
92
94
96
98
100

Fig.7a - j

KEYLESS ACCESS SENSOR SYSTEM

CROSS-REFERENCE TO RELATED APPLICATIONS

This application is a continuation of International application PCT/GB01/02919, entitled "Keyless Access Sensor System" filed Jun. 29, 2001 and published as International Publication No. WO 02/02893 A1, the entire content of which is expressly incorporated herein by reference thereto.

BACKGROUND

The present invention relates to a keyless access sensor system and its associated sensor device for keyless access particularly, but not exclusively, for use in allowing access by an authorized user to a vehicle, building or the like. The invention also relates to a method of using a keyless access sensor system to control entry of authorized persons and to a circuit for processing signals in a keyless access sensor system.

It is important, for many reasons, to control access to premises, vehicles and personal property so that only authorized users are allowed access. Typically this is done using keys which fit a lock to allow the user of the key to open the lock and gain entry. One problem with the existing key and lock arrangements is that loss or damage to the key can render access impossible. In addition, if the key lock itself is blocked or damaged this can also prevent access. One other problem is that the use of a key requires a specific action such as unlocking a door latch with the key from the authorized person before an action of opening the door associated with the door latch. This specific action is very often not easy to accomplish, is not ergonomic and is time-consuming.

A number of solutions have been proposed to try to overcome these disadvantages. With security devices for cars, it is well known that a keyless fob can be used, such that actuation of a button on the fob generates an infrared (IR) or radio frequency (RF) signal which is detected by a sensor in the vehicle which unlocks the doors. A key is still required by the user in order to operate the ignition system. The fob also contains a lock button which generates a similar IR or RF signal to lock the vehicle. Such vehicle keyless access systems have been known for a number of years. Such systems operate on the basis that when the IR or RF "open" signal is generated by the fob, the signal is used to actuate a mechanism which unlocks the car door so that when the user pulls on the handle, the door is already unlocked. Similar arrangements may be used for building entry.

One problem with this arrangement is that the user still has to initiate a specific action such as, in the case of a fob, taking the fob in his hand and pressing on the fob button, or in the case of a magnetic card or the like, inserting the card in a slot or to present it in front of a card reader/detector or the like, in order to unlock the door and have access to the vehicle, these specific actions being time-consuming and not ergonomic.

One other problem with this arrangement is that if the user decides not to enter the vehicle but forgets to actuate the "lock" signal, the car and/or building remains open and is thus vulnerable. In addition, with existing keyless locking systems, particularly for vehicles, a conventional locking mechanism is used which is susceptible to interference by thieves to gain access to the car. For buildings, conventional locks are actuated in the same way and are susceptible to the same procedures by intruders to gain access to the premises.

It is desirable to provide a system which obviates or mitigates at least one of the above mentioned problems, and this is now provided by the present invention.

SUMMARY OF THE INVENTION

The desired features are achieved by providing a keyless access sensor system for use with a keyless access control mechanism (KACM) for controlling the operation of a locking device without any specific action from the user. The KACM receives a signal from a sensor device for keyless access to create a first output signal before the user has begun any action on the handle in order to open the door. The first output signal is sent to a general processor, which initiates a recognition process and, after recognition of the authorized user the general processor then generates an unlocking signal which unlocks the locking device before the authorized user will have fully accomplished the action of opening the door. Thus the authorized user is allowed to open the door without any specific un-ergonomic and time-consuming additional action to the simple action of actuating the handle to open the door. A signal is generated by a device, such as a fob, card or the like, carrying a unique digital or analog identification in response to RF or IR interrogation from the general processor after it receives the output signal from the sensor device for keyless access. In response to the unlocking signal, the locking device is opened for a predetermined time allowing a user entry to a car or building premises or the like.

The sensor device for keyless access generates a primary beam of electromagnetic radiation, particularly in the optical wavelength range and, more particularly, it is a pulsed beam, this beam being located near a door handle. In the case of a vehicle, the beam is located between the door panel and the inside of the handle. Alternatively, the beam is located between the two extremities of the handle and parallel to the door panel in order to detect and anticipate any action of opening the door made by the user. When a user inserts his hand to fully or partially interrupt or reflect the beam after the system is primed, the system detects this modification of the beam characteristics and generates the output signal which is used in anticipation with the user ID to create a control signal to unlock or open the door before any action on the door handle. The sensor device for keyless access may include a backup switch which will provide a signal to the general processor in case the modification of the primary beam characteristics due to the presence of the hand is not detected by the sensor system for whatever reason. This backup switch will be activated by the mechanical action of the user on the door handle in order to open the door. The signal issued from the backup switch will then initiate the user ID sequence and will then allow the unlocking of the door with a delay due to the lack of anticipation in the detection of the action of opening the door by the user. The backup switch may be a mechanical switch or an optical switch or the like. The sensor device for keyless access device may also include a locking switch, which purpose is to cause locking of the door when this locking switch is actuated by the user when he exits the door. In the case of a vehicle the locking switch is locatable on the handle for easy actuation by the user.

In the preferred arrangement, an incident beam is an infrared beam generated by a light emitting device (LED) and is detected by an optical sensing element. After the user inserts his hand to fully or partially interrupt or reflect the beam, a signal processing circuit detects when the interruption or modification of the beam of optical pulses lasts longer than a predetermined time and then generates the output signal to the general processor.

In the preferred arrangement, the sensor device for keyless access is a low power consumption sensor based on smart monitoring of the internal electrical function of the sensor in order to reduce to minimize the overall sensor electrical consumption.

In the preferred arrangement, the sensor device for keyless access is ambient light protected by measuring the level of the ambient light before producing any pulse of the optical beam, in a way which protects the sensor against any external parasitic optical light.

Conveniently, the access multi-sensor device includes an optical adaptive feedback arrangement which prevents the sensor from false detection which may be caused by slow variation of the optical beam characteristics due to, for example, the accumulation of dust or deterioration on the sensor external surface, the variation of electro-optical characteristic of the light emitting device or the variation of the optical sensing element during the sensor's lifetime.

With this arrangement a traditional key lock is not required and, consequently, it is not vulnerable to illegal entry in the same way as traditional locks. When the system is applied to vehicles, the user has no specific manual action to perform to unlock the vehicle, thus improving the ergonomics and access time to the vehicle. The main requirement is a handle or the like, a beam and an access control mechanism which generates a beam of electromagnetic radiation between the handle and the door or between the two extremities of the handle parallel to the door panel so that the beam can be fully or partially interrupted or reflected by a user, for example, when the user inserts his hand between the handle and the door. Such a beam may be modified by other means, such as a card or the like swiped through a slot to generate a-control signal for controlling a locking mechanism.

A particular advantage of this arrangement for use with vehicles is the low power consumption of the sensor circuit, especially in the standby mode. This low power consumption is obtained by having an ultra low consumption sensor device for keyless access and by having the general processor in a standby mode when the car is parked. When the vehicle is parked, the device is 'woken up' by a user interrupting or modifying the beam characteristics and only then does the general processor wake up from its standby mode and cause a RF or IR beam to be generated to verify the user ID. Thus, the RF beam is only generated in response to an access request thereby minimizing power consumption.

Another particular advantage of this arrangement for the use by vehicles is that it will still be fully functional even in harsh environments due to bright artificial lights in towns by night, or high temperature or presence of dust on the car, or the like. This functionality is provided by the optical adaptive feedback system and the ambient light protection function of the sensor device.

BRIEF DESCRIPTION OF THE DRAWING FIGURES

These and other aspects of the present invention will become apparent from the following description, when taken in combination with the accompanying drawings, in which.

Figure 2:
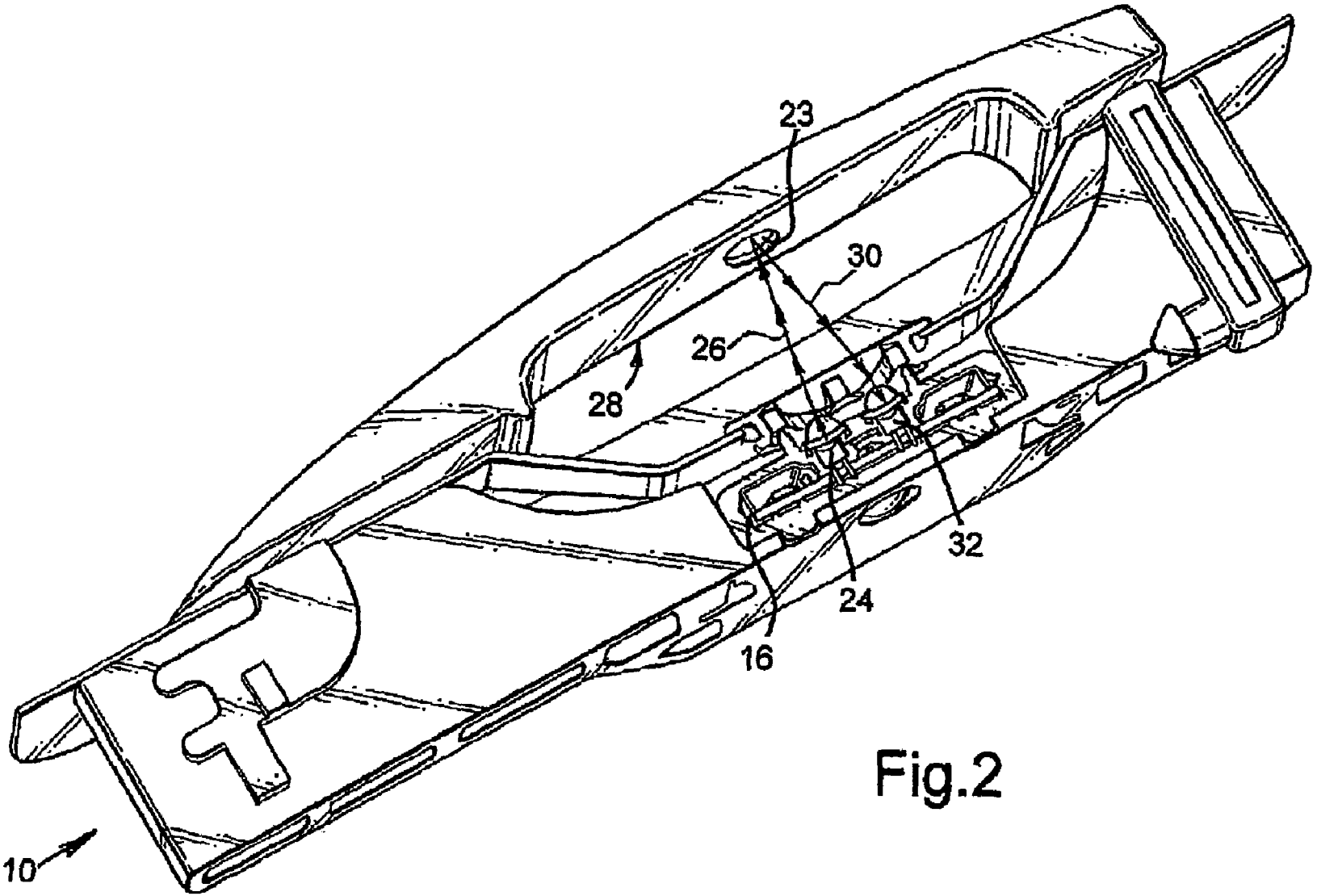
FIG. 2 depicts an assembled and partly cut-away view of the car door handle assembly of FIG. 1 incorporating the sensor system in accordance with the first embodiment of the present invention.
Figure 6:
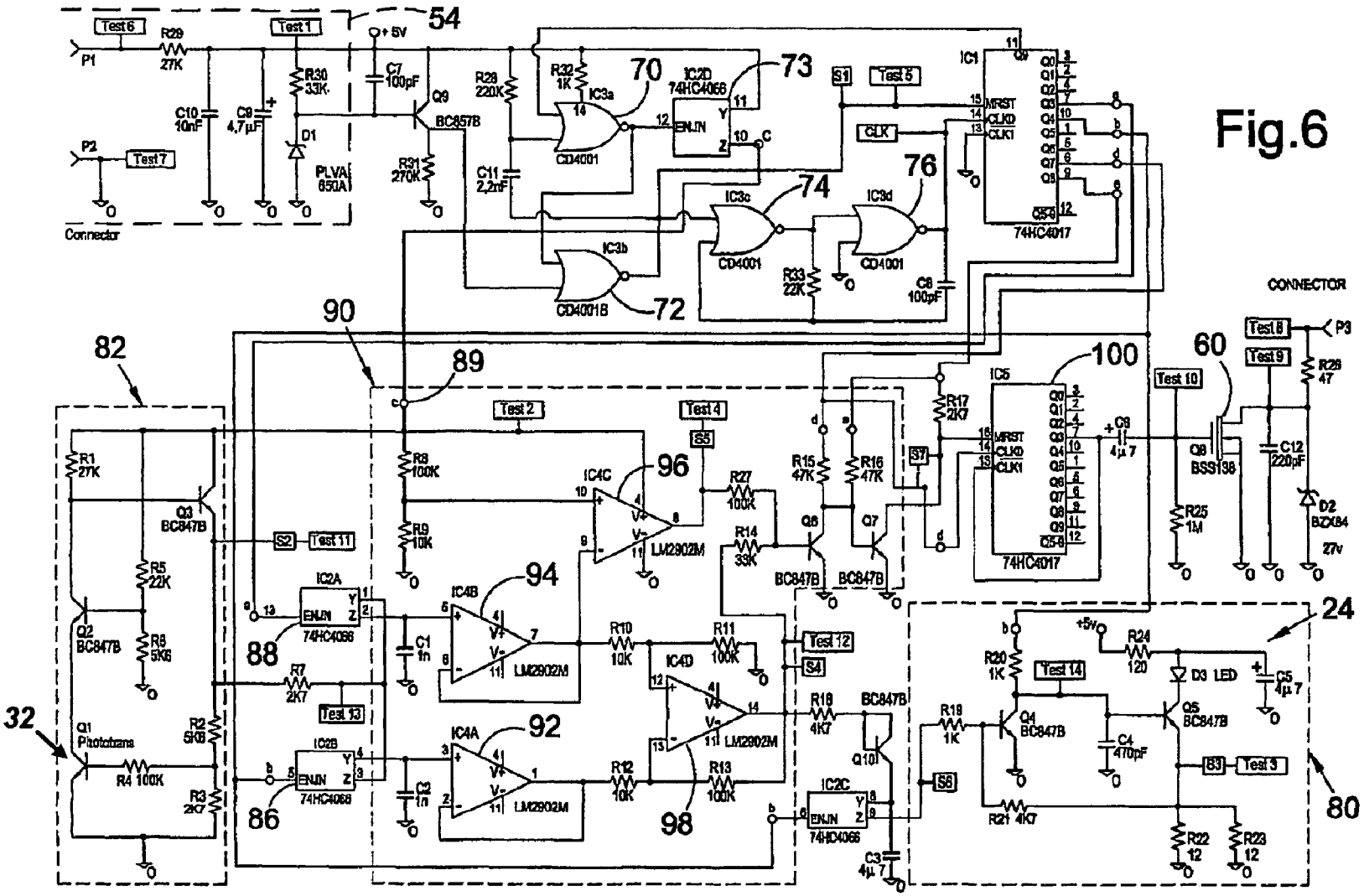
FIG. 6 is a circuit diagram of the sensor device used in FIGS. 1 to 4.
Figure 8:
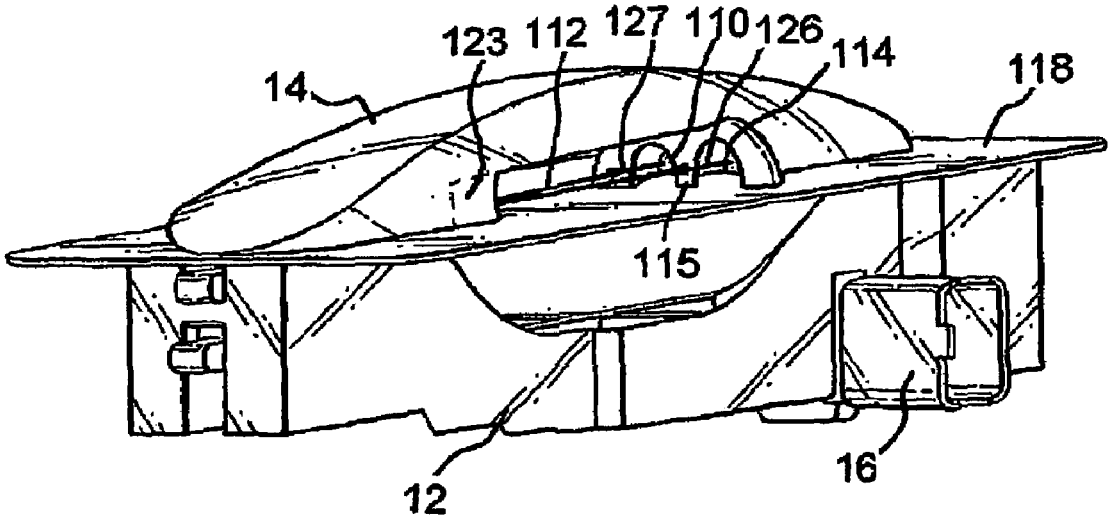
Figure 9A:
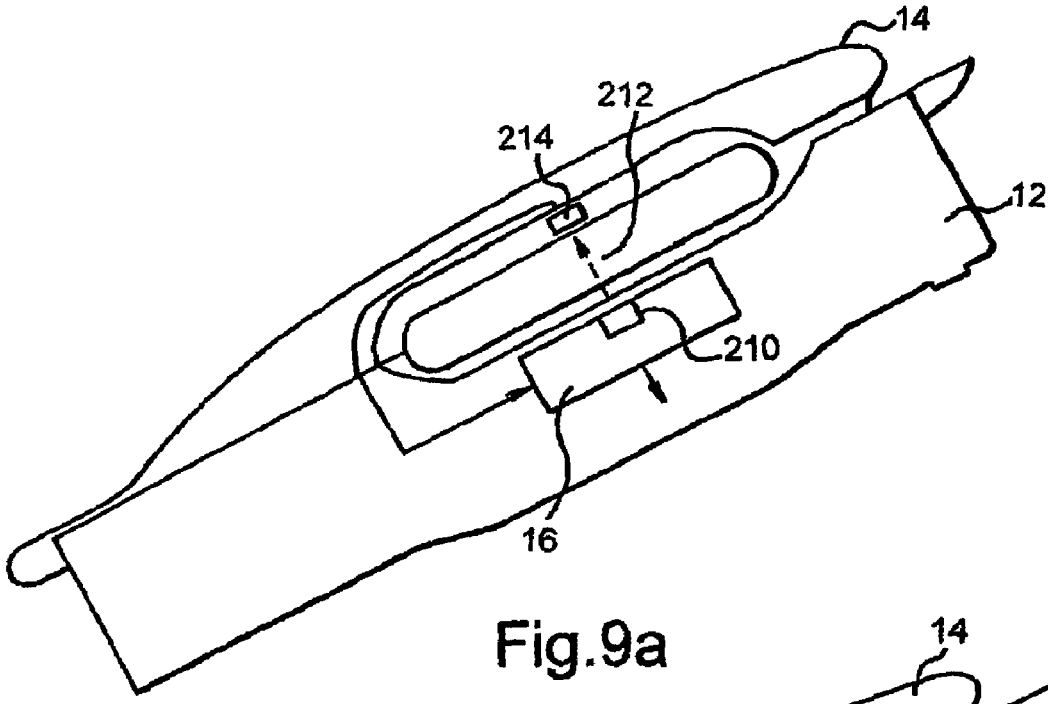
Figure 9B:
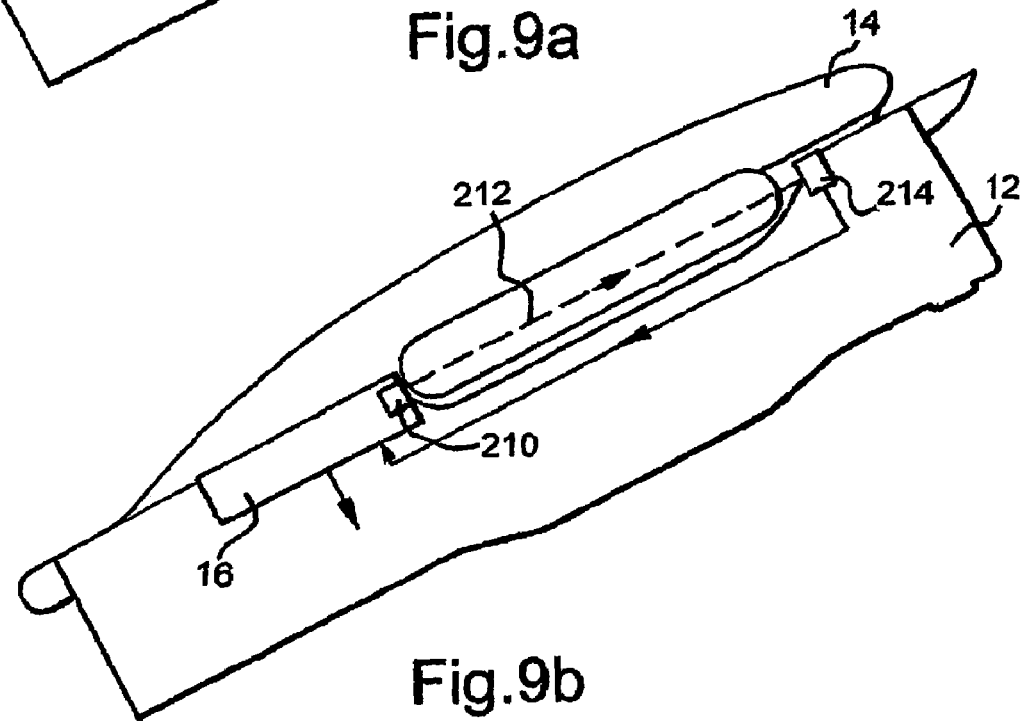
Figure 10:
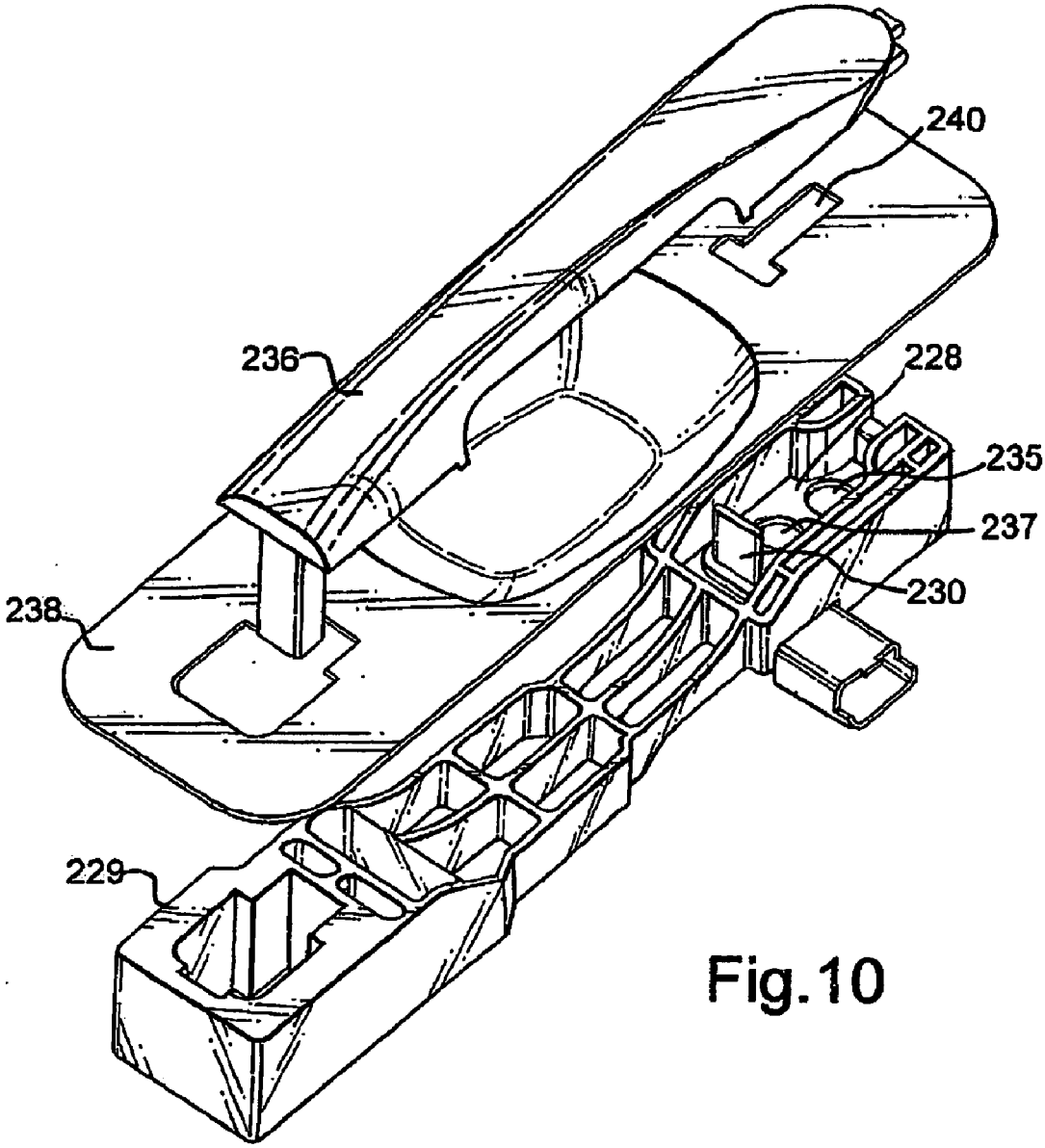

FIGS. 7*a* to 7*j* depict timing diagrams of signals used to control the operation of the circuit of FIG. 6 and waveform diagrams depicting signals at various parts of the circuit of FIG. 6;

FIG. 8 depicts a handle assembly similar to that shown in FIG. 2 but using a sensor device in accordance with an alternative embodiment of the present invention, and FIGS. 9*a*, 9*b* and 10 show further embodiments of sensor devices in accordance with the present invention.

DETAILED DESCRIPTION OF THE PREFERRED EMBODIMENTS

According to one aspect of the present invention, there is provided a sensor system for use with a keyless access control system, the sensor system comprising:

an electromagnetic radiation generating element for generating an incident beam of electromagnetic radiation in the form of a pulse train;

an electromagnetic sensing element for sensing the incident beam, and a signal processor coupled to the sensing element for detecting an interruption to, or modification of, the incident beam, the signal processor including a timer for detecting when the duration of the interruption or modification of the incident beam is greater than a predetermined by detecting the presence of absence of a predetermined number of pulses varying from a predetermined level, the signal processor for providing an output signal to an access control mechanism when the presence of absence of a predetermined number of pulses are counted.

Preferably, the system includes a backup switch for sensing a mechanical opening action of the access control mechanism.

Preferably, the absence of a predetermined number of pulses less than a preset level results in the output signal being generated.

Alternatively, the presence of a predetermined number of pulses greater than a preset level results in the output signal being generated.

Preferably, the sensing element is disposed adjacent to the electromagnetic radiation generating element for detecting a partial or total interruption or modification of the incident beam.

Preferably also, the system includes an optional locking switch for manually locking the access control mechanism.

Conveniently, the optional backup switch is an optical switch and the optional locking switch is an optical switch.

Preferably, the electromagnetic radiation generating element generates an incident beam of optical radiation. Conveniently, the incident beam is an infrared beam. Conveniently, the wavelength is between 780 and 950 nanometers.

According to a further aspect of the present invention, there is provided a method of providing keyless access to a locked device or structure, the method comprising the steps of:

generating an incident beam of electromagnetic radiation, the incident beam being a pulse train, sensing the incident beam of electromagnetic radiation, sensing an partial or total interruption or modification to the incident beam lasting longer than a predetermined timed by detecting the presence or absence of a predetermined number of pulses varying from a predetermined level, and generating an output control signal when the predetermined number of pulses are counted as the result of the partial or total interruption or modification, and processing the generated control signal to produce an actuation signal for opening the access mechanism.

Preferably, the method includes the step of generating a backup interruption signal as a result of a mechanical action on the handle of the access mechanism, and processing the generated interruption signal to produce an output control signal for unlocking or opening the access mechanism.

Preferably, the method includes the step of generating a locking signal as a result of an action on the locking switch.

According to a further aspect of the present invention, there is provided a circuit for use in an electromagnetic radiation sensing system, the circuit comprising:

a circuit power supply regulator;

an output stage with an optical source for emitting pulses of electromagnetic radiation of a predetermined duration;

a sensing and amplification stage for detecting pulses emitted by the optical source;

a timing circuit coupled to the power supply regulator for generating timing signals and an internal power supply, the timing signals and the internal timing power supply being fed to the amplification stage and to the output stage for synchronizing the emission and detecting of light pulses varying from a predetermined level, and a pulse counter for counting the pulses, the pulse counter generating an output signal in response to a predetermined number of pulses being counted.

Preferably also, the timing signals are also used to detect and remove ambient light noise.

Preferably, the circuitry is partially or totally realized in a monolithic ASIC (Application Specific Integrated Circuit).

Preferably, the ASIC includes the optical sensing element.

According to a further aspect of the invention there is provided a sensor device for use with a keyless access control mechanism, the sensor device comprising:

a post for incorporation into one end of a door handle;

an electromagnetic radiation emitter and receiver located in the post for generating an incident beam of electromagnetic radiation substantially parallel to the handle, and for receiving a reflected beam of electromagnetic radiation;

a signal processing circuit coupled to the emitter and receiver for detecting a partial or total interruption or modification of the incident beam, the signal processing unit generating an output signal when the interruption or modification to the beam is detected for transmitting to an access control mechanism.

Figure 1:
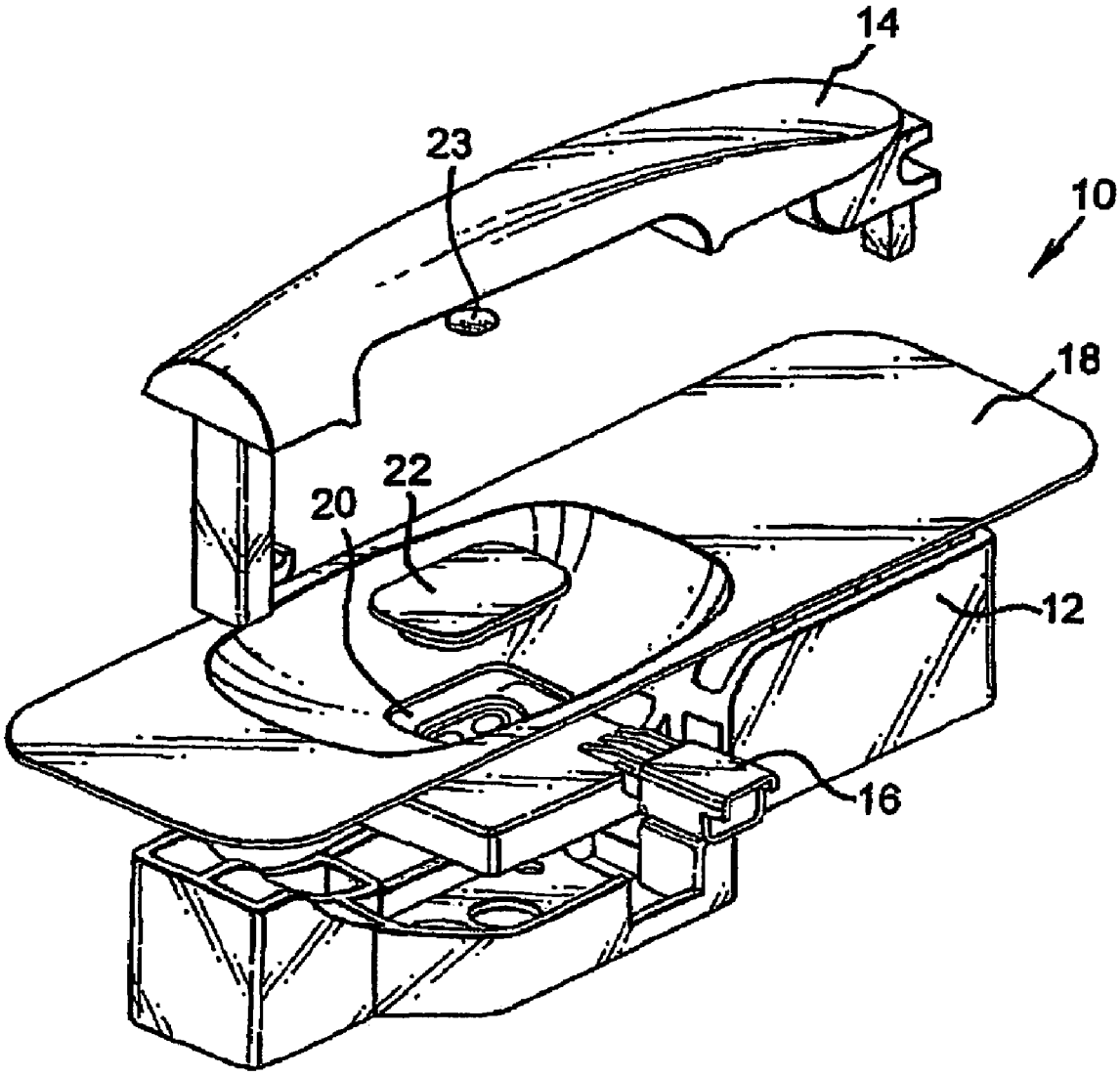
FIG. 1 is an exploded view of a car door handle assembly incorporating a sensor system in accordance with a first embodiment of the present invention.

Reference is first made to FIG. 1 of the drawings which depicts a car door handle assembly, generally indicated by reference numeral 10. The assembly consists of a door bracket assembly 12, a door handle 14 and an access sensor device 16. The door bracket assembly and the sensor device 16 are disposed beneath the door skin 18. In this embodiment the door skin 18 defines an aperture 20 which receives a lens protector assembly 22 through which an infrared (IR) beam generated by the sensor device 16 passes to be reflected by a mirror 23 back to the sensor device 16, as will be later described in detail.

Reference is now made to FIG. 2 of the drawings which depicts a cross-section of the door handle assembly 10 shown in FIG. 1. In this diagram it will be seen that the sensor device 16 has a light emitting diode (LED) 24 which emits incident IR beam 26 which is reflected by the mirror 23 disposed in the inside 28 of the door handle 14 and the reflected beam 30 is detected by a photo-transistor 32. As will be described, the IR beam is provided by a 1 KHz pulse frequency, to minimize power consumption. As long as the pulses are emitted and are detected by the circuit, a signal is provided from the circuit output which maintains the door in a locked position. As will also be described, if the IR beam is partially or totally interrupted or modified the beam level detected is compared with preceding pulse levels and if a reduced signal level is detected for a predetermined number of pulses, taking about 3 milliseconds, in this embodiment three pulses, the sensor interprets this as an authorized user wishing to open the door and provides an output signal which is fed to a general processor of a control module which generates a RF signal for interrogating a user's digital ID on a card. When a satisfactory response is obtained, i.e. the user's ID matches e stored digital data and a control signal is generated by the processor to unlock the locking mechanism and allows the door to be opened.

Figure 3:
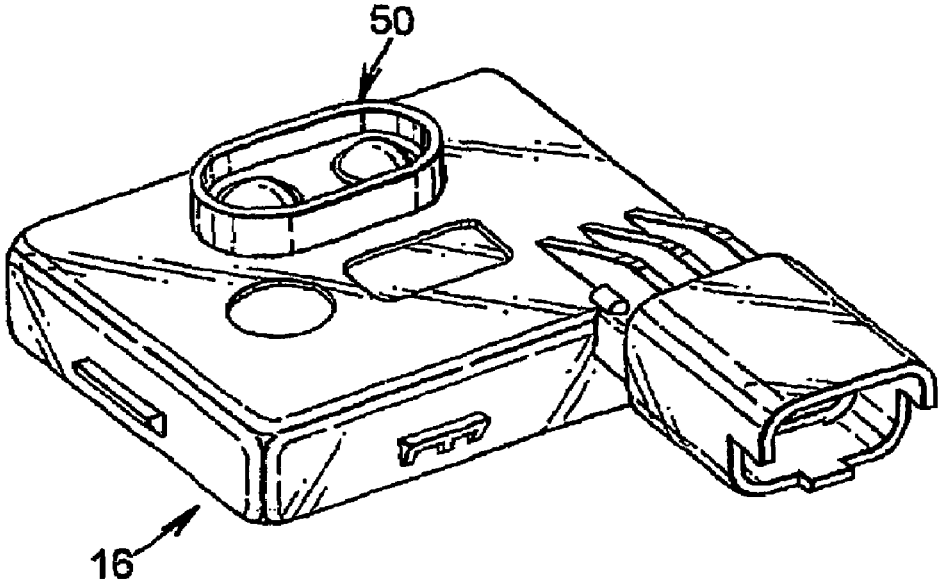
FIG. 3 is a perspective view of an assembled sensor unit as shown in the drawings of FIGS. 1 and 2.
Figure 4:
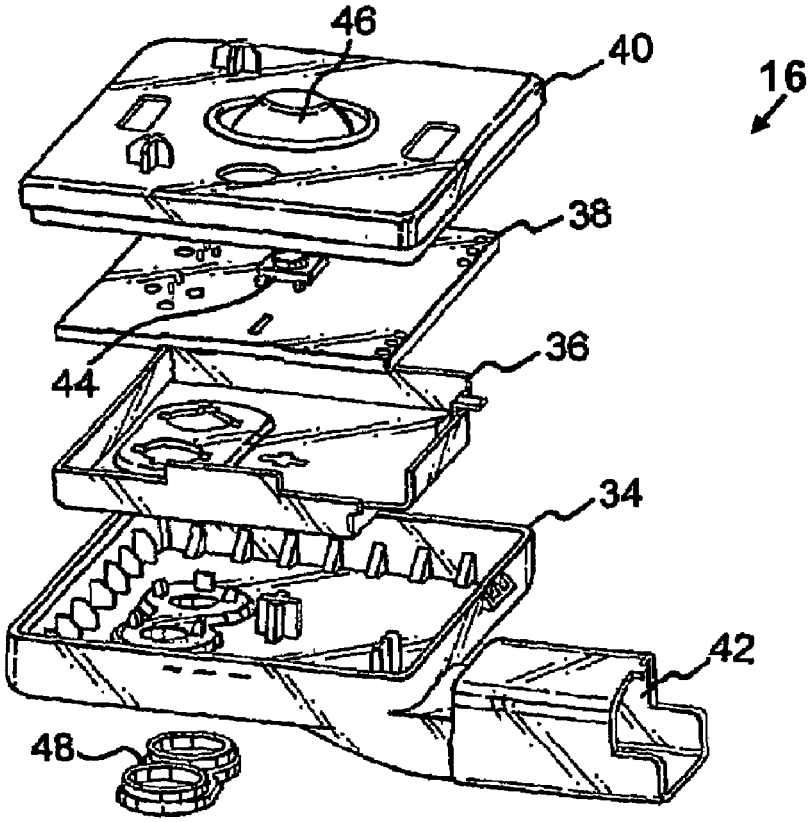
FIG. 4 depicts an exploded view of the sensor unit shown in FIG. 3.

Reference is now made to FIGS. 3 and 4 of the drawings, which depict the sensor device 16. The device 16 consists of four principal parts, as best seen in FIG. 4: an optical enclosure 34; an electromagnetic shield 36; a printed circuit board assembly 38, and an optical enclosure cover 40. The optical enclosure cover 40 has a connector interface 42 which interfaces with the vehicle control conductors. The printed circuit board assembly contains a microswitch 44 which can be operated via a flexible membrane 46 disposed in the optical enclosure cover for detecting the beginning of handle motion, i.e. within a 3 mm movement. The microswitch 44 is a backup to the optical detection system to allow a user to unlock or open the door if the optical sensor fails, the signal from the backup switch replaces the signal from the sensor and is dealt with by the general processor in the same way to allow unlocking of the door. A dual lens 48 is disposed in the recess 50 in the optical enclosure for covering the LED and photo-transistor as shown in FIG. 2.

Figure 5:
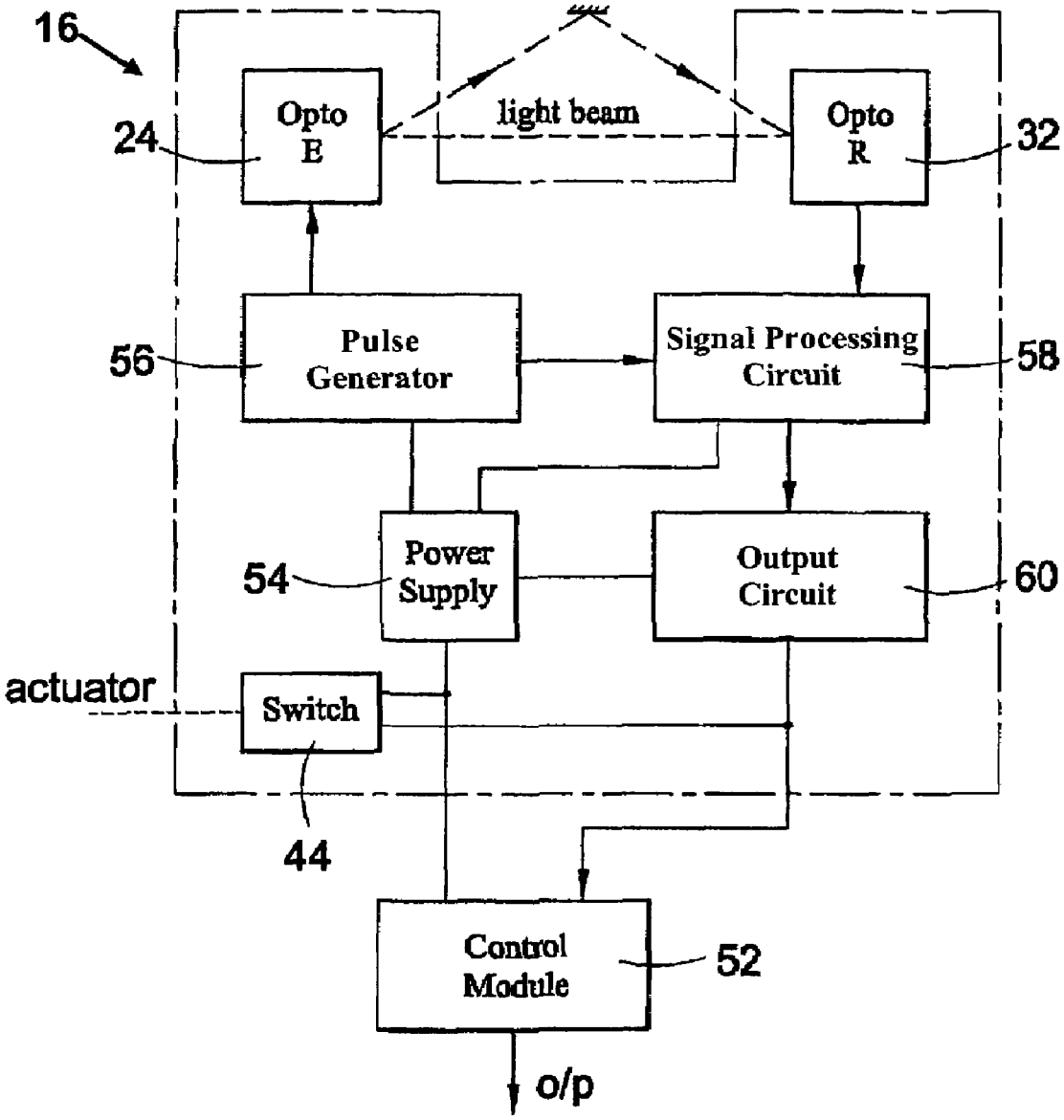
FIG. 5 is a general block diagram of the sensor device used in FIGS. 1 to 4.

FIG. 5 shows a block diagram of the circuit used in the sensor device 16. A control module 52 interfaces with the circuit and is coupled to current power supply 54 which supplies power to the main circuit components; pulse generator circuitry 56; signal processing circuit 58 for processing the output from the photo-transistor 32, and output circuit 60 for providing an output to the control module 52, and the microswitch 44.

The pulse generator 56 generates pulses at a rate of 1 KHz and the frequency signal is fed to the LED 24 and to the signal processing circuitry 58 to synchronize detection of signals by the photo-transistor 32. As long as both sets of pulses are received, a counter in the processing circuitry 58 is continually reset to zero and the output circuitry 60 does not generate an output signal. When the light beam is interrupted such that a predetermined number of light pulses, in this case three, are not received by the photo-transistor, the signal processing circuitry 58 detects this and actuates the output circuitry 60 to generate an output signal to the control module 52. The control module 52, in turn, causes a RF signal to be generated and when a suitable response is received confirming the ID of a user, the control module 52 sends a signal to unlock the door. This response time is about 3.0 to 3.5 milliseconds (MS) and by the time the user pulls the door handle 14, the door is already unlocked.

Figure 7:
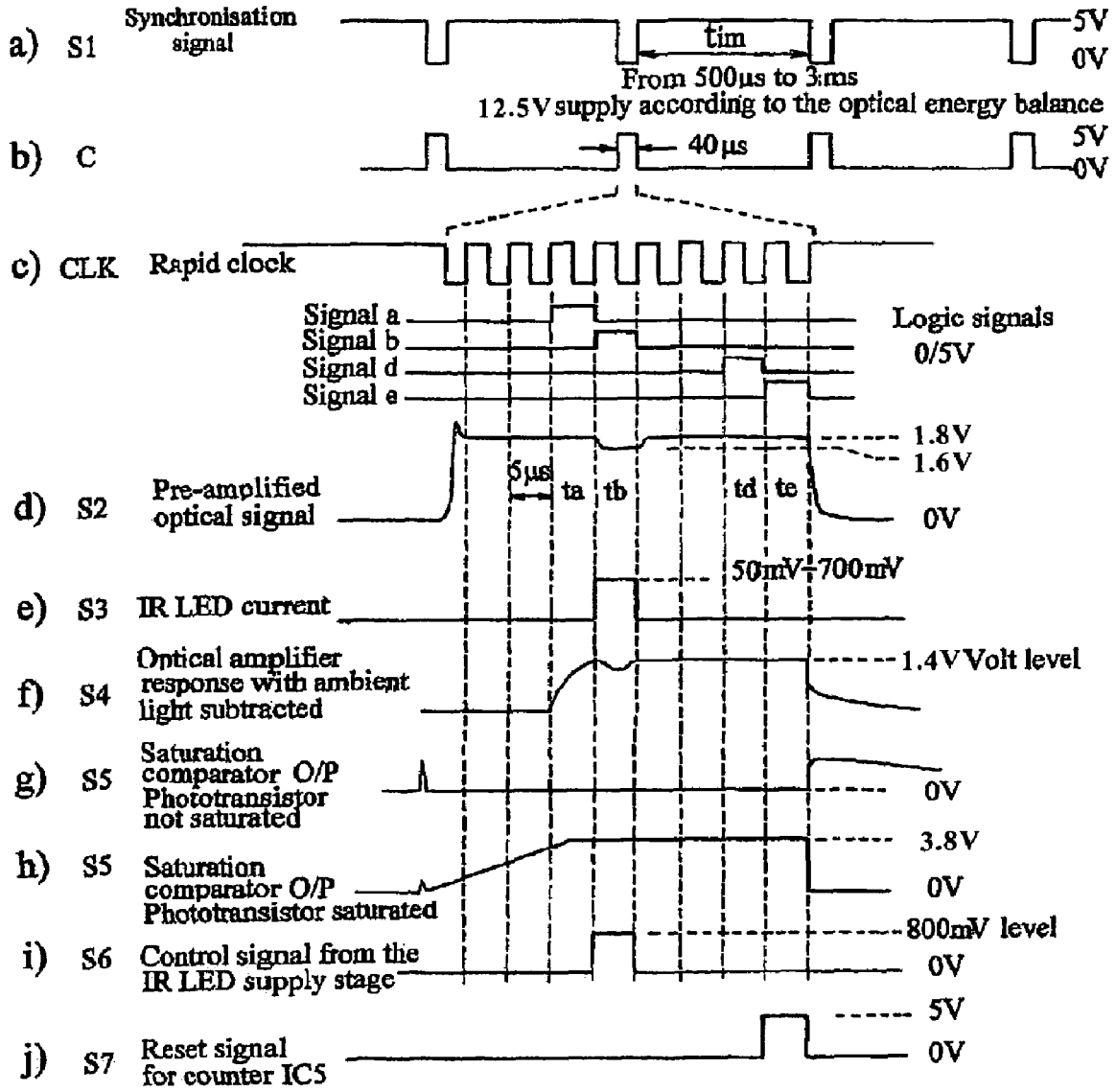

Reference is now made to FIGS. 6 and 7 of the drawings. FIG. 6 is a circuit diagram of the circuitry used to generate the pulsed IR signal, for detecting the signals reflected from the mirror 23 and also for detecting when the reflected signal is interrupted. FIGS. 7*a* to 7*j* depict the various signals associated with the circuit of FIG. 5.

The circuit of FIG. 6 is designed to minimize power consumption and, consequently, in power supply 54 the supply current is limited by a 27 kΩ resistance R29 in series with the supply which is normally between 9V and 16V. If the operating voltage is +5V, the supply current is equal to the quotient of the supply voltage tess 5V divided by the value of resistance R29. For example, for a 9V power supply, the supply current will be 150 A, and for a 24V power supply, the current will be 700 A. This is so that 4.7 μF capacitor C9 can be charged sufficiently rapidly to enable the LED 24 to be driven at currents up to 100 mA in pulse mode as will be described.

The available supply voltage to transistor Q9 is set by avalanche diode D1. Just after a measurement is taken, C9 has been partially discharged and the voltage across C9 is too low to maintain the operating voltage of 5V (several dozens of mV below the set voltage) and the constant supply current recharges capacitor C9, the voltage of which rises until the set voltage level. At this time, the transistor Q9 conducts sufficiently to trigger the flip-flop formed by the two NOR gates 70,72 in IC3A, IC3B and the next measurement is initiated by synchronization signal S1 falling to zero volts as shown in FIG. 7*a*. Capacitor C7 filters high frequency variations in the power supply which may otherwise produce inadvertent signals.

Voltage level setting is principally achieved by avalanche diode D1 which behaves like a Zener diode and is designed to operate with a weak current. The operating current is set by resistance R30 and is about 20 A. This current value is a function of the variation in the base emitter voltage of Q9 and temperature and the value decreases slightly at high temperatures and rises slightly at lower temperatures, varying about 1 A per 15° C. At this operating current the avalanche diode is stable at a voltage of about 4.4 V. The operating voltage (+5 V) is equal to the avalanche diode voltage (4.4 V) increased by $V_{be}$ (−0.6 V) of resistor Q9.

The system is protected against excessive voltage by a shunt regulator formed by avalanche diode D1 and the base-emitter junction of transistor Q9. The system is limited to supplying voltage less than 6.5 V even for an input voltage greater than 100 V. The shunt regulator allows a supply current as high as 3.5 mA resulting from 100 V continuous input supply. However, resistance R29 is limited to the power dissipation of 0.1 W which corresponds to a permanent over-voltage of 57 V.

For polarity inversion, resistance R29 limits the current without damaging the diodes in the substrates of the CMOS and HCMOS.

The operation of the circuit will be explained by describing how parts of the circuit are set up to generate various voltages and timing signals and then the generation and detection of pulses will be described.

A measurement is initiated by transistor Q9. The collector voltage is always around half of the supply voltage. This voltage rises when the available energy in C9 is sufficient to perform a measurement. When the voltage reaches the threshold level of NOR gate 72, the output changes state and the flip-flop formed by NOR gates 70, 72 memorizes the sequence of measurements from the start (S1—FIG. 7*a*). When the measurement is complete, the output of Q9 resets the flip-flop. The R28, C11 combination at the input of gate 70 and gate 74 is to provide a reset in case the system starts in a "hang-up" consumption mode with no oscillator providing a clock signal.

Due to the R29, C9 time constant, the establishment of the 5V level is relatively slow. The flip-flop formed by NOR gates 70, 72 in IC3*a* and IC3*b* begins operating at a low voltage of 1 V to 1.5 V, before many other components on the circuit. The flip-flop can begin working with the S1 output high or low, if the flip-flop begins working with S1 low, i.e. 0 V, it means that the electronic circuit is powered at 1 V to 1.5 V before the 5 V level is reached. This results in a relatively high current consumption of several mA. Because the resistor R29 limits the input current to less than 0.3 mA, the internal voltage cannot reach 5 V and the IC3*a*/IC3*b* flip-flop cannot be reset and the circuit stays in a non-working high current consumption mode. This situation is prevented by the R29, C11 combination which effectively acts as a "CPU watchdog" by resetting the IC3*a* and IC3*b* flip-flop after 500 s if the flip-flop remains in the state with the S1 output in a 0 V state. This stops the power supply to the electronics and removes the electronics from the non-working high current consumption mode. The internal power supply can therefore reach +5 V required to power the circuit under normal operating conditions. Under normal operating conditions the S1 output remains low for 45 s and the 500 s reset period does not disturb the normal functionality of the electronics.

The synchronization signal Si is taken from the output of gate 72. The output of gate 70 (IC3*a*) is fed to a sample and hold circuit 73 (IC2D) where it will be seen that the output at pin C, as shown in FIG. 7*b*, is the inverse of the synchronization signal S1. The output of sample and hold 72 is fed to pin 89 of circuit 90 to supply power to the analog circuits only during the 40 s period of the +5 V pulse. This means that all of the signal processing as shown in FIGS. 7*c*–7*j* takes place within this 40 s period, thereby minimizing electrical power consumption.

NOR gates 74, 76 form an oscillator (see signal CLK in FIG. 7*c*) with an oscillator period of 5 s set by the combination R33, C8. The capacitor C8 has a thermally stable dielectric to avoid frequency variations during operation. The oscillator supplies the clock signal to the IC1 counter which provides:

(a) at pin D3, a pulse sampling the level of ambient light;
(b) at pin D4, a pulse indicating illumination of the LED as well as a pulse sampling the level of the signal (ambient and LED signals);
(c) at pin D7 and pin D8, pulses for signals amplified by the operational amplifier 1C4;
(d) at pin D9, the pulse is deleted from the memory (counter IC5) after the start of measurement.

These logic signals are depicted as signals a, b, d and e with respective pulse widths $t_a$, $t_b$, $t_d$ and $t_e$ as shown in FIG. 7*c* of the drawings.

The LED emitting stage, generally indicated by reference numeral 80, will now be described.

A pulse of light is emitted by LED 24 which is connected between the supply and the collector of transistor Q5. The current through the LED is measured by the drop in voltage across resistances R22, R23 in parallel, and is shown as signal S3 in FIG. 7*e*. This controls the power emitted by Q4 in the following manner. When the clock pulse rises at the output "D4" of counter IC1 at time $t_b$, the current at the base of the transistor Q5 rises to about 4 mA across resistor R20. The transistor Q5 causes the LED shown in waveform S3 to saturate until the current across the LED is sufficient to cause transistor Q4 to conduct, as it receives part of the current supply from Q5. The combination Q4, Q5 creates a feedback mechanism and the combination self-stabilizes for a LED current between 0–100 mA, the value depending on the control signal as shown in waveform S6 in FIG. 7*i* being supplied to transistor Q4. The 470 pF capacitor C4 delays the conduction of transistor Q5 until the switching of the general clock to avoid a current peak being produced before transistor Q4 is enabled. The R24,C5 supply combination prevents the LED current causing a glitch in the supply voltage which could affect the operation of the photo-detector stage. The LED supply stage only operates at "high current"; the current at the base of resistor Q5 is about 4 mA and the current at the base of resistor Q4, which is the current which controls supply of power to the LED, rises to 0.1 mA when the system is used in full visibility. Full visibility is the maximum level of ambient light. This is why the control current is provided only during the time the LED is illuminated.

The photo-detection and pre-amplification stage, generally indicated by reference numeral 82, is provided by the photo-transistor 32 shown coupled to the emitter of transistor Q2 which reduces the effect of high frequency signals on the capacitance of the base emitter of Q1. The collector voltage of Q2 is also coupled to the collector of photo-transistor Q1 to provide a low impedance at the stage output which is shown by pre-amplified optical signal S2 shown in FIG. 7*d*. Resistors R2 and R3 form a voltage divider for transistor Q1 and the voltage is supplied across 100 kΩ resistor R4 to the photo-transistor Q1. This sets the sensitivity of the pre-amplifier to −300 mV per photo-current microamp on the base of the photo-transistor Q1. The pre-amplifier stage 82 thereby provides a negative voltage pulse when it receives a pulse of light. This stage consumes 600 A and has a rise time about 2 s. It is supplied throughout the cycle of the general clock which is about 40 s (FIG. 7*c*) for a frequency of 1 KHz.

The operating point of the stage 82 with no photo-current is around three times $V_{be}$ of Q1, i.e. 1.8 V at output, thereby fixing the collector current of Q1 and Q2 at around 100 A. The divider bridge R5R6 fixes the base potential of Q2 at 1 V. No decoupling is present to give the pre-amplifier a very short availability time. The output signal is available after 5 to 10 s from S2.

The output of the pre-amplification stage is fed to sample and hold circuits 86, 88 via resistance R7 and prevents the first stage being subjected to capacitance which can cause instability. First sample and hold circuit 86 operates during the clock cycle $t_a$ in order to sample the level of ambient light before illumination of the LED. The second sample and hold circuit 88 operates during illumination of the LED during time $t_b$ in order to sample the signal level. The latter sampled signal, being lower than the ambient signal, is fed to the inverting input of the differential amplifier, generally indicated by reference numeral 90, formed by three amplifiers of 1C4 (IC4A, IC4B, IC4D). IC4 contains four operational amplifiers, generally indicated by reference numeral 92, 94, 96, 98. The differential amplifier has a gain of 10. The operational amplifiers 92, 94, 96, 98 selected are classic type LM324 for low cost, low power consumption (about 600 A) and a low operating voltage of about 4 V. Its gain and slew rate are sufficient to provide stable output after 30 s. Like the photo-detection stage, the operational amplifier is only supplied for 40 s each time a measurement is taken. The amplifier output signal is shown as signal S4 in FIG. 7*f* of the drawings.

The output signal from the differential amplifier, signal S4, is routed through blocking diode D2. The output voltage is retained by capacitance C3 and is the voltage used to control the emission of the light pulse from LED 24. The voltage retained by C3 can be set by adjusting the time constant set by the combination R18, C3 and by the percentage of time signal S4 is present. The discharging time constant is defined by the combination R19, C3 and by the duty cycle ($t_b$) of closure of switch IC2C. Time constants can be calculated for operating at a thousand measurements per second as follows: rising time constant: R18=2.7 K, C3=4.7 pF and the signal S4 about 20 s, giving a result of about 0.88 seconds. The discharging time constant, R19=1K, C3=4.7 pF and the switch opening time is about 5 s which gives a result of about 0.94 seconds. Signal S6 in FIG. 7*i* depicts the voltage for controlling the LED supply.

The fourth amplifier of IC4 96 compares the voltage corresponding to the level of ambient light with a fixed threshold of 500 mV. When the pre-amplifier is illuminated by a large light signal (for example, bright sunlight), the signal is below the 500 mV threshold and the output voltage of the operational amplifier 96 rises to saturation as shown in signal S5 in FIG. 7*h*.

In use, saturation is detected by the illumination of the photo-transistor, i.e. when the LED illuminates and, the signal S5 rises to 3.8 V which is the saturation voltage of amplifier IC4C. The current through R34 saturates transistor Q6 from the time $t_b$ until the time $t_e$. Likewise, when the pulse from the LED 24 is correctly received, the output of differential amplifier 90 rises to around 1.4 V and the current through resistor R14 switches on transistor Q6. From the time $t_b$ until the time $t_e$ the collector of Q6 is pulled towards the supply potential by R15 and R16 during time $t_d$ and $t_e$. If one of the two conditions above (or if both simultaneously) are present, the transistor Q6 will become saturated and the potential of the collector will not rise, thus transistor Q7 will remain off. Q7 is the transistor which blocks or allows the pulses to reset the counter 1C5 100. On the other hand, if the photo-transistor 32 does not receive pulses of light, or is not saturated by ambient light, transistor Q6 remains off and Q7 will be saturated during time $t_e$.

In addition, the counter IC5 100 processes the output signals from amplifier 90 in accordance with the timing signals. If transistor Q7 remains off, the counter IC5 will be reset to zero at the end of each measurement during time $t_e$ (signal S7 in FIG. 7*j*). If transistor Q7 switches on, as indicated above, each pulse for resetting the counter to zero will not be delivered but the counter receives a clock pulse for each measurement during time $t_d$, therefore, the counter counts as long as the signal is interrupted and the counter is reset to zero when the interruption ceases. If three successive pulses due to an interruption are counted, the counter switches off its active output until the removal of the optical barrier. The number of successive pulses measured during interruption of the signal by the system can be set between 1 and 9, although 3 has been found to be particularly convenient since at a frequency of 1 KHz this means an output is provided in 3 mS.

After detecting three successive pulses due to interruption of the LED signal, the output of the counter is fed to a MOS transistor 60 via the RC combination formed by R25 and C6 to provide a pulse of around 100 mseconds. Output as provided by the drain of Q8 through current limiting resistor R26. Protection against high voltage and polarity inversion is provided by Zener diode D4.

The aforementioned circuit has the principal advantage of being low cost, uses standard components and has very low current and power consumption with an average current consumption of about 0.2 mA because self-biasing circuitry is used. Regulation of the circuit supply is used to achieve a response time which allows high frequency illumination of the LED and high frequency operation of the amplifier. The supply voltage can vary between typically 9 and 16 V and the LED needs to be energized with pulses of 5 s duration to provide satisfactory functioning.

In this way it will be seen that the circuitry provided minimizes power consumption because power is only supplied to the circuitry for the duration of the period of the pulses of the synchronization signal which is particularly advantageous in a vehicle or any other application where minimizing electrical power consumption is important. The use of pulses to control illumination of the LED and the detection of an absence of those pulses for a predetermined number of cycles is advantageous.

It will be appreciated that various modifications may be made to the apparatus described above without departing from the scope of the invention. An alternative embodiment of sensor device is shown in FIG. 8 of the drawings which is preferred for use with vehicles. In this case the light source 110 and detector 114 are located in a post 115 disposed at one end of the handle 14. In this case a reflector 123 (shown in broken outline) is located at the opposite end of the handle 14. Thus, it will be seen that the incident beam 126 and reflected beam 127 are parallel to the handle 14 and to the door skin 118. This embodiment has the advantage that an additional hole in the door skin 118, such as that shown in FIGS. 1 and 2, is avoided because the post can use the same hole as the handle 14. The reflector 123 is located to minimize the possibility of dirt being deposited, whether by a user or otherwise, on the mirror reflector 123. Thus, a lens protector is also unnecessary in this embodiment. The user can modify the optical beam characteristic by placing his hand anywhere on the door providing an ergonomic advantage. This arrangement is simpler and is easier and less expensive to install.

Further, alternative embodiments are shown in FIGS. 9*a* and 9*b* of the drawings, which depict a car door handle assembly similar to that shown in FIGS. 1 and 2 in which LED 210 generates an incident beam 212 which is detected directly by a photo-transistor 214 without the use of a mirror. When the user inserts his hand between the LED 210 and the photo-transistor 214 it breaks or modifies the beam 212 in the same way as described above. The light emitting diodes and photo-transistors can be positioned as appropriate to facilitate interruption of a beam by a user. Thus, FIG. 9*b* shows the beam parallel to the door skin 18 similar to that shown in FIG. 8. These alternative arrangements can be provided to operate with the same or similar circuit to that described above.

A further embodiment of the invention is shown in FIG. 10 which is similar to the arrangement shown in FIG. 8. In this embodiment sensor enclosure 228 is mounted in door bracket 229, and a post or light-pipe 230 and also may be configured to carry a light source and a detectors, which can be arranged in the same way as depicted in FIG. 8, that is they are disposed adjacent each other, the same distance along the post axis. The enclosure 228 also has mechanical back-up and locking switches 235, 237 respectively. There is no reflector in this embodiment and the sensor circuit operates by detecting light reflected from a user's hand when inserted between the handle 236 and the door skin 238. The circuit is substantially identical to that of FIG. 6 but as long as no reflected pulses are received, the counter in the receiving circuitry 58 is continually set to zero and the output circuitry does not generate an output pulse. The counter IC5 100 is set up so that if three successive pulses of light are detected following reflection from a user's hand, the counter generates an output signal which is fed to the MOS transmitter as described above with reference to FIG. 6. Thus, the circuit only produces an output when the beam is reflected by a user, and in combination with the user's ID signal, an unlocking signal is sent to the door so that when the user pulls on the handle the door is already unlocked. The power supply to the circuit is also only supplied during the period of the synchronization circuit to minimize power consumption and, as before, all measurements and signal processing take place within this 40 s period.

This embodiment has the advantage of minimizing cost: a reflector is not required and the post 230 uses the same aperture 240 in the door as the handle facilitating assembly. Because a reflector is not required, problems associated with the reflector such as keeping it clean and amplifying power are avoided.

Reference is also made to a further embodiment of the invention which is similar to the arrangement shown in FIG. 1 but without the reflector 23. In this embodiment the signal is reflected back to the detector 16 by the user's hand. The sensor circuit operates in the same way as described with reference to FIG. 10; counting a predetermined number of pulses present results in an output signal which is fed to a MOS transistor for generating a control signal to unlock the door as described above.

Various other modifications may be made to the apparatus and circuitry hereinabove described without departing from the scope of the invention. Certain applications and minimizing of power consumption may not be necessary, for example in buildings and the like where mains power supply is available and the power consumption required by the sensor system may be regarded as minimal. In such a case the IR optical signal could be provided by a continuous signal and actuation of the unlocking mechanism could be achieved by detecting the absence of the continuous signal for a predetermined period or by counting a number of pulses as described above. The LED and photo-transistor may be located separately from the handle. For example, a slot could be provided in a door or entry to a building and a plastic card, similar to a credit card of the like, could be swiped between the slot to interrupt the beam and the output of the signal processing circuitry could be used to unlock a mechanism to allow a user to open a door which is remote from a sensing mechanism.

The sensor device has a number of advantages which allow its use in a variety of applications, such as in vehicles, buildings and the like. The use of a partially or totally modified or interrupted beam to detect the presence and absence of an object has a variety of applications. For example, it may be used as a rain sensor and for detecting and counting the passage of objects interrupting the beam. The structure has a number of advantages which facilitate widespread use, such as low power consumption during use, the use of up to 100 mA drive current provided to the IR LED to generate a high power optical pulse to minimize the effect of dirt and the like on the lenses and reflectors, where used, fast frequency response compatible with high frequency pulses, a wide operating temperature range and good noise immunity to ambient light changes and electromagnetic interference. Synchronization of the detection of the light impulses provides good immunity against parasitic electrical signals and radio signals and the use of a counter to detect predetermined period of interruption minimizes the effect of spurious signals causing malfunctioning of the circuitry.

What is claimed is:

1. A sensor system for a keyless access control, the sensor system comprising:

an electromagnetic radiation generating element for generating an incident beam of electromagnetic radiation in the form of a pulse train;

an electromagnetic sensing element for sensing the incident beam, and a signal processor coupled to the sensing element for detecting an interruption to, or modification of, the incident beam, the signal processor including a timer for detecting when the duration of the interruption or modification of the incident beam is greater than a predetermined time by detecting the presence or absence of a predetermined number of pulses varying from a predetermined level, the signal processor providing an output signal to an access control mechanism when the presence or absence of a predetermined number of pulses are counted.

2. The system of claim 1 wherein the sensing element is disposed adjacent to the electromagnetic radiation generating element for detecting a partial or total interruption or modification of the incident beam.

3. The system of claim 1 wherein the sensing element is disposed remotely from the electromagnetic radiation generating element for detecting a partial or total interruption or modification of the incident beam.

4. The system of claim 1 including a beam reflector spaced from the radiation generating element for receiving the incident beam and for producing a reflected beam, the sensing element sensing the reflected beam.

5. The system of claim 1 wherein the electromagnetic radiation generating element generates an incident beam of infra-red radiation.

6. The system of claim 1 wherein the electromagnetic radiation generating element is a light emitting diode.

7. The system of claim 1 wherein the electromagnetic radiation generating element is a laser.

8. The system of claim 7 wherein the laser is a laser diode.

9. The system of claim 1 wherein the electromagnetic sensing element is a photo-detector device.

10. The system of claim 9 wherein the photo-detector device is a photo-diode.

11. The system of claim 9 wherein the photo-detector device is a photo-transistor.

12. The system of claim 1 wherein the signal processor is provided by CMOS circuitry and includes an output MOSFET for providing an output signal to actuate the access mechanism.

13. The system of claim 1 wherein a backup switch is coupled to the signal processor for actuation by a user in the event of failure of the signal processor to generate the output signal to the access control mechanism.

14. The system of claim 13 wherein the backup switch is a mechanical or optical switch.

15. The system of claim 1 wherein the signal processor is coupled to a separate locking switch, the locking switch being actuatable by a user to lock the system.

16. The system of claim 15 wherein the locking switch is an optical or mechanical switch.

17. The system of claim 1 further comprising a means for measuring a level of ambient light before producing from said electromagnetic radiation generating element, an optical pulse to prevent sensor system response to changes in ambient light.

18. The system of claim 1 wherein power is supplied to the signal processor only during a period when a power supply pulse is supplied to the sensor system to minimize power consumption.

19. A method of providing keyless access to a locked device or structure, the method comprising the steps of:

generating an incident beam of electromagnetic radiation, the incident beam being a pulse train;

sensing the incident beam of electromagnetic radiation;

sensing a partial or total interruption or modification to the incident beam lasting longer than a predetermined time by detecting the presence or absence of a predetermined number of pulses varying from a predetermined level;

generating an output control signal when the predetermined number of pulses are counted as the result of the partial or total interruption or modification; and processing the generated control signal to produce an actuation signal for opening an access mechanism.

20. The method of claim 19 further comprising the steps of:

reflecting the incident radiation beam from a reflecting element, and detecting the reflected radiation beam; and generating an output signal in response to an partial or total interruption of the incident or reflected radiation beam.

21. The method of claim 19 further comprising the step of detecting the presence of a beam reflected by a reflecting object and generating an output signal in response to a total or partial interruption or modification of the beam.

22. The method of claim 19 further comprising the steps of:

generating an infra-red signal to form an incident electromagnetic radiation signal; and detecting the infra-red signal to provide a sensed signal for processing to control actuation of the access mechanism.

23. A circuit for sensing the presence of an object, the circuit comprising:

an electromagnetic radiation generating element for generating an incident beam of electromagnetic radiation in the form of a pulse train;

an electromagnetic sensing element for sensing the incident beam;

a signal processor coupled to the sensing element for detecting an interruption or modification to the beam by an object for detecting the presence or absence of a predetermined number of pulses varying from a predetermined level, the signal processor providing an output signal when the predetermined number of pulses are counted, and a power management unit coupled to the signal processor for supplying power to the circuit only during the period when a power supply pulse provided by a power supply to the circuit is supplied to minimize power consumption.

24. The circuit as claimed in claim 23 wherein the object sensed is a raindrop.

25. A method of sensing the presence of an object, the method comprising the steps of:

generating an incident beam of electromagnetic radiation, the incident beam being in the form of a pulse train;

sensing the incident beam of electromagnetic radiation;

sensing a partial or total interruption or modification to the incident beam by the presence of an object by detecting the presence or absence of a predetermined number of pulses varying from a predetermined level;

generating a control signal as the result of the interruption or modification of the incident beam when a predetermined number of pulses are counted; and processing the generated control signal to produce an output signal corresponding to the beam interruption or modification; and processing signals by a sensor processor only during a period when a power supply pulse provided by a power supply is supplied to a sensor circuit to minimize power consumption, wherein said sensor circuit generates the incident beam of electromagnetic radiation, senses the incident beam of electromagnetic radiation, senses the partial or total interruption or modification to the incident beam by the presence of the object by detecting the presence or absence of the predetermined number of pulses varying from the predetermined level, generates said control signal, processes the generated control signal to produce the output signal and processes the signals by the sensor processor during the period when the power supply pulse provided by the power supply is supplied to the sensor circuit to minimize power consumption.

26. The method as claimed in claim 25 wherein the sensor circuit senses the presence of rain.

27. A circuit for use in an electromagnetic radiation sensing system, the circuit comprising:

a circuit power supply regulator;

an output stage with an optical source for emitting pulses of electromagnetic radiation of a predetermined duration;

a sensing and amplification stage for detecting pulses emitted by the optical source;

a timer coupled to the power supply regulator for generating timing signals and an internal timing power supply, the timing signals and the internal timing power supply being fed to the sensing and amplification stage and to the output stage for synchronizing the emission and detecting of a plurality of light pulses and minimizing the electrical power consumption; and a pulse counter for counting the plurality of light pulses, the pulse counter generating an output signal in response to a predetermined number of light pulses being counted which vary from a predetermined level.

28. The circuit of claim 27 wherein the counter generates an output signal in response to the absence of a predetermined number of pulses less than a preset level.

29. The circuit of claim 27 wherein the counter generates an output signal in response to the presence of a predetermined number of pulses greater than a preset level.

30. The circuit of claim 27 wherein the circuit is provided by an application specific integrated circuit.

31. The circuit of claim 30 wherein the ASIC incorporates an electromagnetic radiation detector.

32. The circuit of claim 27 wherein the circuit is used in a keyless access control mechanism and the output signal is used to actuate the keyless access control mechanism.

33. A sensor device for use with a keyless access control mechanism, the sensor device comprising:

a post for incorporation into one end of a door handle;

an electromagnetic radiation emitter and receiver located in the post for generating an incident beam of electromagnetic radiation substantially parallel to the handle, and for receiving a reflected beam of electromagnetic radiation;

a signal processing circuit coupled to the emitter and receiver for detecting a partial or total interruption or modification of the incident beam, the signal processing circuit generating an output signal when the interruption or modification to the beam is detected for transmitting to the keyless access control mechanism;

wherein the post includes a back-up switch, the back-up switch being mechanically coupled to the handle and electrically coupled to the signal processing circuit for actuation by a user to cause the signal processing circuit to generate the output signal in the event of failure of an optical system;

wherein the post further includes a locking switch, the locking switch being mechanically coupled to the handle and to the signal processing circuit, the locking switch being actuatable by a user to send a locking signal to the keyless access control mechanism;

wherein the signal processing circuit includes a counter for counting pulses received from the detector, the signal processing circuit providing an output signal when the counter counts the presence of a predetermined number of detected pulses greater than a preset level.

* * * * *